United States Patent [19]

Minor

[11] Patent Number: 4,695,723

[45] Date of Patent: Sep. 22, 1987

[54] CORONA-CHARGING APPARATUS

[75] Inventor: James C. Minor, Rochester, N.Y.

[73] Assignee: Eastman Kodak Company, Rochester, N.Y.

[21] Appl. No.: 744,079

[22] Filed: Jun. 10, 1985

[51] Int. Cl.[4] ..... G03G 15/02; H01T 19/00

[52] U.S. Cl. ..... 250/325; 250/324; 355/3 CH; 355/14 CH; 361/229; 361/230; 361/255

[58] Field of Search ..... 250/325, 324; 355/3 CH, 355/14 CH; 361/230, 235, 229

[56] References Cited

U.S. PATENT DOCUMENTS 4,025,186 5/1977 Hunt et al. ..... 355/14 R 4,451,137 5/1984 Farley ..... 355/14 CH

*Primary Examiner*—Craig E. Church

*Assistant Examiner*—Jack I. Berman

*Attorney, Agent, or Firm*—Milton S. Sales

[57] ABSTRACT

A corona-charging apparatus for charging successive image area segments of a charge-receiving element, which corona-charging apparatus is capable of adjusting the charging rate from one segment to the next while minimizing the transition region between successive image area segments, includes electrode means for creating a corona discharge and a composite grid between the electrode means and a moving charge-receiving element. The composite grid includes a plurality of conductive controlled grid sets with at least one grid wire per set. The grid sets are spaced in the direction of movement of the charge-receiving element, and the voltage on each grid set is adjustable independently of the voltages on the other grid sets. Regulator means are provided for synchronizing the voltage of each grid set with the movement of the charge-receiving element.

3 Claims, 6 Drawing Figures

CORONA-CHARGING APPARATUS

BACKGROUND OF THE INVENTION

1. Field of the Invention

This invention relates to apparatus for establishing a uniform, predetermined charge on successive image segments of a charge-receiving element.

2. Description of the Prior Art

Although the corona-charging apparatus of the present invention has general applications, one preferred application is in the field of electrophotographic apparatus (herein called copiers). In copier corona-charging apparatus, current from a corona-emitting electrode establishes a generally uniform electrostatic charge on an image segment of a charge-receiving element having a photoconductive insulating layer. The charged segment is then advanced to an exposure station where it is exposed to image-forming radiation to form a latent electrostatic image of a document to be copied. The latent image is thereafter developed and substantially transferred to paper upon which the copied image is to appear.

Various methods are known for adjusting the charge on a charge-receiving element by the corona-charging apparatus. For example, the speed of the charge-receiving element past the corona-emitting electrode can be varied to adjust its time of exposure to corona current. Another method for adjusting the charge is to vary the charging rate. Control electrodes (known as grids), to which has been applied a potential approximately equal to that to which the charge-receiving element is to be charged are located between the corona-emitting electrode and the element. Current flow from the electrode to the element can be adjusted by varying the voltage of the grid.

Very possibly, the optimum grid voltage changes between successive original documents, and high-quality reproduction can best be obtained when the charging rate is adjusted between image segments to compensate for variances in background density of the original documents. Such adjustment of the charging rate between image segments is not new, and has been effected by changing the grid voltage after the trailing edge of one image segment has cleared the corona-charging apparatus and before the leading edge of the next image segment reaches the apparatus. However, this process undesirably requires the charge-receiving element to contain a physical transition region between the trailing edge of one image area segment and the leading edge of the next image area segment so that no portion of either image area segment is below the corona-charging apparatus during the period of grid voltage change. Thus, the image area segments on the charge-receiving element must be spaced apart by a distance equal to at least the width of the corona-charging zone (i.e., the dimension of the charge-receiving apparatus in the direction of movement of the charge-receiving element).

The need for providing such spaces between the successive image area segments reduces the number of image area segments which can be located within a predetermined length of charge-receiving element. This in turn necessitates driving the charge-receiving element at a faster linear speed to make a predetermined number of copies per unit time than would be necessary if the image area segments were closer together in order to produce the same number of copies per unit time.

SUMMARY OF THE INVENTION

It is therefore an object of the present invention to improve the overall output of an apparatus with an adjustable corona-charging apparatus by providing means for adjusting the charging rate from one segment to the next while minimizing the transition region between successive image area segments.

The foregoing, as well as other objects and advantages, are accomplished by providing a novel corona-charging apparatus. The apparatus includes electrode means for creating a corona discharge and a composite grid between the electrode means and a moving charge-receiving element. The composite grid includes a plurality of conductive controlled grid sets with at least one grid wire per set. The grid wires extend in a direction transverse to the charge-receiving element, and the voltage on the wires of each grid set is adjustable independently of the voltage on the wires of the other grid sets. Regulator means are provided for synchronizing the voltage of the wires of each grid set with the movement of the charge-receiving element. Thus, voltage on a grid set can be changed when that grid set is over the transition region between the trailing edge of one image area segment to the leading edge of the successive image area segment, and the transition region need only be as wide as the width of one grid wire set. This greatly reduces the length of the transition region and increases the number of image area segments which can be located on a predetermined length of charge-receiving element.

BRIEF DESCRIPTION OF THE DRAWINGS

In the detailed description of the preferred embodiments of the invention presented below, reference is made to the accompanying drawings in which.

DESCRIPTION OF THE PREFERRED EMBODIMENT

The corona-charging apparatus of the present invention has general applications, but will be described herein in a form particularly useful in electrophotographic apparatus (i.e., copiers). Because such apparatus is well known, the present description will be directed in particular to elements forming part of or cooperating more directly with the present invention.

Figure 1:
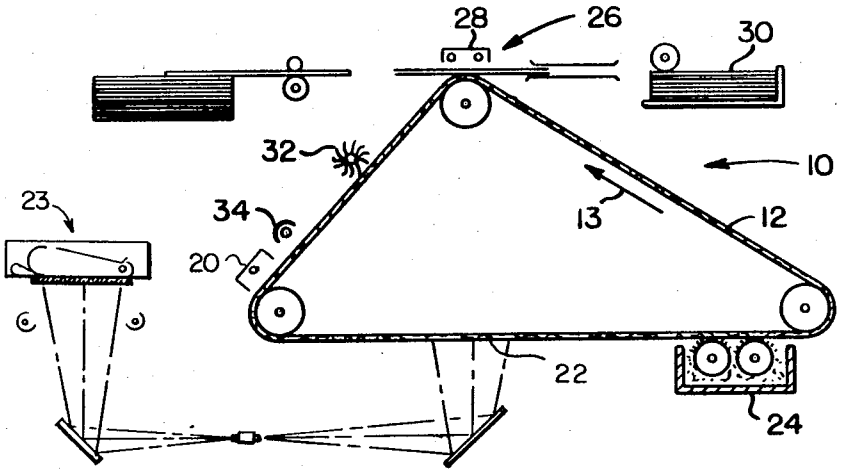
FIG. 1 is a side elevational view in schematic form of a portion of electrophotographic apparatus in accordance with the invention.

With reference to FIG. 1, a web-type copier 10 includes a charge-receiving element 12 mounted for movement in the direction of arrow 13 about an endless path, past various operative stations. As can be seen more clearly in FIG. 2, charge-receiving element 12 includes a photoconductive insulating layer 14 (e.g., of the type disclosed in U.S. Pat. No. 3,615,414) overlying a thin, electrically-conductive layer 16, both supported on a film 18. The conductive layer is electrically connected to ground or other reference potential source by edge contact with rollers of the apparatus or by other techniques known in the art.

Operative stations of copier 10 include a charging station at which corona-charging apparatus 20 applies an overall primary charge to the external surface of photoconductive insulating layer 14. After receiving the primary charge, an image area segment of charge-receiving element 12 advances past an exposure station 22 where the segment is imagewise exposed to image-forming radiation from a document located on the platen of a recirculating feeder 23. The resultant latent electrostatic image then residing on the segment is next advanced over a magnetic brush development station 24 where toner is attracted to the charge pattern corresponding to dark image areas of the document. The developed image is then advanced to a transfer station 26 where the toner image is transferred by corona discharge device 28 to paper, fed from supply 30.

The image segment from which the toner is transferred advances past a cleaning station 32 in preparation for another copy cycle. Erase illumination source 34 can be located after the cleaning station to dissipate residual charge prior to initiating another copy-making sequence of the image segment.

Figure 2:
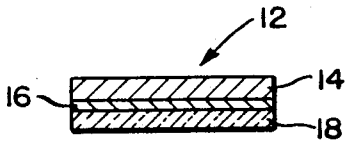
FIG. 2 is an enlarged cross-sectional view of the charge-receiving element of the apparatus shown in FIG. 1.
Figure 3:
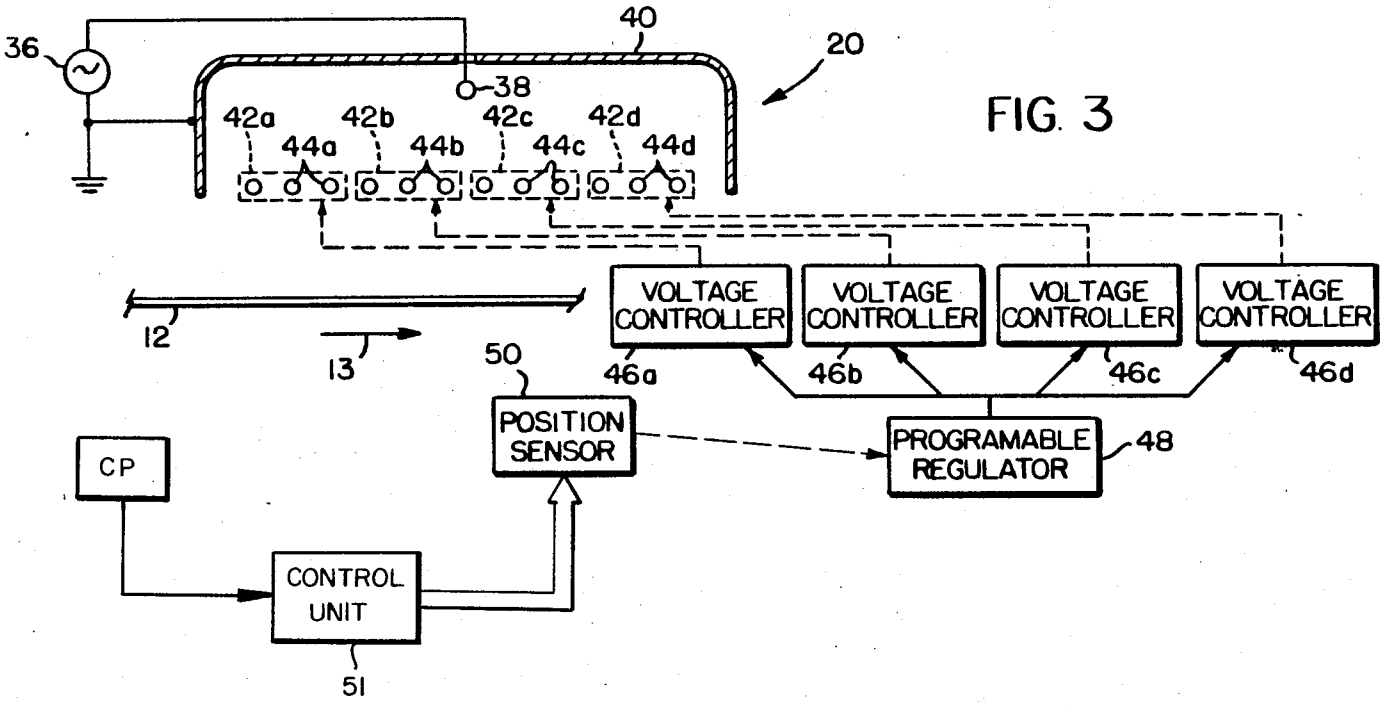
FIG. 3 is a schematic view of corona-charging apparatus in accordance with the present invention.

FIG. 3 illustrates details of a preferred embodiment of corona-charging apparatus of FIG. 1. A high voltage AC power supply 36 is connected to a corona-emitting electrode 38. Electrode 38 is enclosed in a grounded shield 40. A portion of a charge-receiving element 12, such as illustrated in FIG. 2, is shown moving below shield 40.

A composite conductive grid is positioned between corona-emitting electrode 38 and charge-receiving element 12. The composite grid is formed of a plurality of conductive control grid sets 42*a*–42*d* which are in turn made up of at least one grid wire 44*a*–44*d* per set. The grid wires are uniformly spaced from and extend in a direction transverse to the direction of movement of the charge-receiving element. In the illustrative embodiment of FIG. 3, only one corona-emitting electrode is provided in the corona-charging apparatus; but one or more electrodes could be provided per control grid set 42.

Each control grid set has associated therewith a voltage controller 46*a*–46*d* for regulating the charge on one or more grid wires which make up that control grid set. The voltage controllers may have a programmable active DC voltage source, as is well known in the art.

Voltage controllers 46*a*–46*d* are adjusted by a programmable regulator 48 which is in turn responsive to a charge-receiving element position sensor or encoder 50. Sensor 50 may be of the kind, for example, which senses perforations placed along one edge of web-like charge-receiving element 12 in predetermined relation to the image areas thereon. Such an arrangement is described in U.S. Pat. No. 4,025,186, issued May 24, 1977 to W. E. Hunt et al. The position sensor detects the spatial relationship of the successive image area segments to the charge-receiving element at corona-charging apparatus 20, whereupon voltage controller 46*a* sequentially adjusts the voltage of the grid wires 44*a* of control grid set 44*a* in accordance with the characteristics of the document original corresponding to that image area segment and in timed relation with the movement of the charge-receiving element.

An example of instances wherein copier production parameters are advantageously changed in accordance with the characteristics of the document original is described in U.S. Pat. No. 4,451,137, issued May 29, 1984 to R. W. Farley. Briefly, that patent discloses that during a production run of copying a multi-sheet document orginal using a recirculating feeder, predetermined adjustments of the production parameters for individual sheets of the document original may be stored in the copier's memory for later use.

Thus, the parameters for copying successive sheets of a document original may be inputted at a central processor CP (FIG. 3) and stored in the memory of a logic and control unit 51. As the image area segment for one sheet of the document original advances under the corona-charging apparatus in accordance with the present invention, successive control grid sets are adjusted in succession to the same potential. Upon passage of the trailing edge of the image area segment, the programmable regulator adjusts each voltage controller in turn to set the voltage at the just past control grid set to the proper voltage for the next succeeding image area segment for reproducing the next sheet of the document original.

It is therefore apparent that the transition region spacing between image area segments need be no more than the width of the individual control grid sets.

Figure 4A:
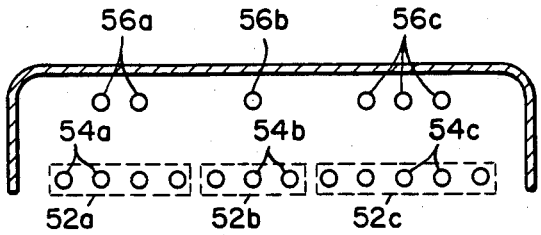
FIGS. 4*a*–4*c* are schematic views similar to FIG. 3 showing alternative embodiments of a portion of the corona-charging apparatus in accordance with the present invention.
Figure 4B:
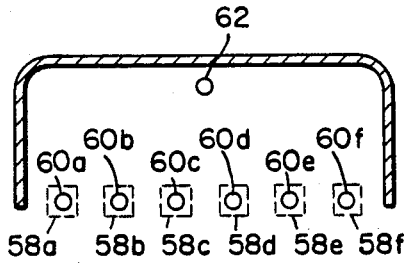
Figure 4C:
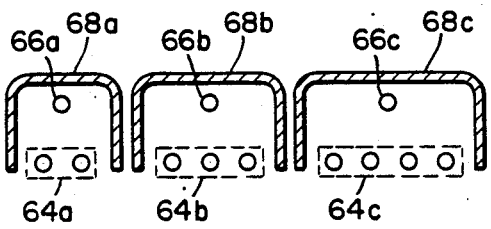

As mentioned above, the control grid sets may be formed of one or more grid wires per set, and each set may have one or more corona-emitting electrodes associated therewith. On the other hand, and as illustrated in FIG. 3, one corona emitting electrode may be associated with more than one control grid set. Further, all of the control grid sets and corona-emitting electrodes need not be located in the same shield, but may be in separate shields. FIGS. 4*a*–4*c* summarize many of the possible combinations of corona-charging apparatus according to the present invention. For example, FIG. 4*a* shows a plurality of control grid sets 52*a*–52*c*, each set being formed of a plurality of grid wires 54*a*–54*c* and each set having one or more corona-emitting electrodes 56*a*–56*c*. FIG. 4*b* shows a plurality of control grid sets 58*a*–58*f*, each set being formed of a single grid wire 60*a*–60*f* and a single corona-emitting electrode 62 servicing all control grid sets. FIG. 4*c* shows a plurality of control grid sets 64*a*–64*c*, each set being formed of a plurality of grid wires with a single corona-emitting electrode 66*a*–66*c* per set and each set being within its own shield 68*a*–68*c*. Of course other possibilities will occur to those skilled in the art, the purpose of FIGS. 4*a*–4*c* being merely to show that many combinations are possible, and not to be exhaustive.

The invention has been described in detail with particular reference to certain preferred embodiments thereof, but it will be understood that variations and modifications may be effected within the spirit and scope of the invention.

I claim:

1. In corona-charging apparatus having corona electrode means for charging successive image segments of a moving charge-receiving element such that the charging rate from an image segment to the next may be adjusted in the transition region between the trailing edge of one image segment and the leading edge of the next image segment, the improvement comprising:

a composite grid including a plurality of conductive control grid sets with at least one grid wire per set between the electrode means and the charge-receiving element, and extending in a direction transverse to the direction of movement of the charge-receiving element, control means for adjusting the voltage of each of said grid sets independently of other grid sets to cause corona discharge to effect a predetermined charge on the portion of the charge-receiving element aligned with each grid set, and regulator means for said control means synchronized with the movement of the charge-receiving element such that the voltages of said control grid sets are adjusted respectively when the control grid set is aligned with the transition region of the charge-receiving element.

2. In corona-charging apparatus comprising:

a plurality of means for charging successive image segments of a moving charge-receiving element such that the charging rate from an image segment to the next is adjustable in the transition region between the trailing edge of one image segment and the leading edge of the next image segment;

control means for adjusting the charge produced by each of said charging means independently of other charging means to cause corona discharge to effect a predetermined charge on the portion of the charge-receiving element aligned with each charging means, and regulator means for said control means synchronized with the movement of the charge-receiving element such that the voltages of said charging means are adjusted respectively when the charging means is aligned with the transition region of the charge-receiving element.

3. In corona-charging apparatus comprising:

a plurality of means for charging successive image segments of a moving charge-receiving element such that the charging rate from an image segment to the next is adjustable in the transition region between the trailing edge of one image segment and the leading edge of the next image segment, said charging means includes a plurality of control grid sets;

control means for independently adjusting the voltage of each of said grid sets to regulate the charge produced by each of said charging means independently of other charging means to cause corona discharge to effect a predetermined charge on the portion of the charge-receiving element aligned with each charging means; and regulator means for said control means synchronized with the movement of the charge-receiving element such that the voltages of said charging means are adjusted respectively when the charging means is aligned with the transition region of the charge-receiving element.

* * * * *